US008045908B2

(12) United States Patent
Hayase et al.

(10) Patent No.: US 8,045,908 B2
(45) Date of Patent: Oct. 25, 2011

(54) FIXING DEVICE AND IMAGE FORMING APPARATUS

(75) Inventors: Toru Hayase, Toyokawa (JP); Kazunori Nishinoue, Toyohashi (JP); Naoki Yamamoto, Toyohashi (JP); Hideaki Hayashi, Toyokawa (JP); Taizou Oonishi, Hachioji (JP); Norikazu Okabe, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/707,840

(22) Filed: Feb. 18, 2010

(65) Prior Publication Data

US 2010/0209153 A1 Aug. 19, 2010

(30) Foreign Application Priority Data

Feb. 18, 2009 (JP) ..... 2009-035325

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 5,999,788 | A * | 12/1999 | Kanesawa et al. | 399/329 |
| 2006/0216077 | A1* | 9/2006 | Komuro | 399/328 |
| 2007/0025784 | A1* | 2/2007 | Ito et al. | 399/329 |
| 2008/0095557 | A1* | 4/2008 | Horie | 399/329 |
| 2009/0052958 | A1* | 2/2009 | Okuno et al. | 399/329 |
| 2009/0208263 | A1* | 8/2009 | Hanyu et al. | 399/329 |

FOREIGN PATENT DOCUMENTS

| | | | |
|---|---|---|---|
| JP | 11-231702 | A | 8/1999 |
| JP | 11-231704 | A | 8/1999 |
| JP | 2001-142327 | | 5/2001 |
| JP | 2005-300732 | | 10/2005 |
| JP | 2005-331576 | | 12/2005 |
| JP | 2007-079183 | | 3/2007 |
| JP | 2009-047959 | A * | 3/2009 |
| JP | 2009-198567 | A * | 9/2009 |

OTHER PUBLICATIONS

Office Action (Preliminary Notice of Rejection) dated Jan. 18, 2011, issued in the corresponding Japanese Patent Application No. 2009-035325, and an English Translation thereof.

An Official Action issued in Japanese Patent Application No. 2009-035325 dated May 24, 2011, and English translation thereof.

* cited by examiner

*Primary Examiner* — Sophia S Chen

(74) *Attorney, Agent, or Firm* — Buchanan Ingersoll & Rooney PC

(57) ABSTRACT

A fixing device has a presser member, a slide member and a pressure belt. Both ends of the presser member are positioned outside both ends of the slide member. Both ends of the slide member are positioned outside both ends of the pressure belt. Thereby, the slide member and the pressure belt are improved in service life, so that the fixing device as a whole is improved in service life.

12 Claims, 6 Drawing Sheets

FIXING DEVICE AND IMAGE FORMING APPARATUS

CROSS-REFERENCE TO RELATED APPLICATION

This application is based on application No. 2009-035325 filed in Japan, the entire content of which is hereby incorporated by reference.

TECHNICAL FIELD

The present invention relates to a fixing device used in, for example, copiers, laser printers, facsimiles or the like, and relates to an image forming apparatus having the fixing device.

BACKGROUND ART

Conventionally, there has been a fixing device provided with a heating roller, a pressure belt contacting the heating roller, a presser member placed inside the pressure belt so as to press an inner surface of the pressure belt toward the heating roller, and a sliding sheet placed between the pressure belt and the presser member (JP 11-231702 A).

The presser member is smaller in width than the pressure belt, and both widthwise ends of the presser member are positioned inside both widthwise ends of the pressure belt. Generally, the sliding sheet has width roughly equal to width of the presser member.

SUMMARY OF INVENTION

In the conventional fixing device described above, however, stress concentration caused by the both ends (edges) of the presser member has occurred in the sliding sheet and the pressure belt because both widthwise ends of the presser member are positioned inside both widthwise ends of the pressure belt.

Greater wear has been found in the stress-concentrated portions of the sliding sheet and the pressure belt than other portions. Due to this, the sliding sheet and the pressure belt have been decreased in service lives, so that the fixing device using them has been decreased in service life.

Accordingly, an object of the present invention is to provide a fixing device and an image forming apparatus which improves in service lives of the sliding sheet and the pressure belt so that the apparatus as a whole can be improved in service life.

In order to achieve the above-mentioned object, one aspect of the present invention provides a fixing device comprising: a heating rotation unit and a pressure rotation unit which rotate together in mutual contact; a heating section for heating the heating rotation unit; a presser member placed inside the pressure rotation unit to press the pressure rotation unit toward the heating rotation unit; and a slide member placed between the pressure rotation unit and the presser member and slid in contact with an inner surface of the rotating pressure rotation unit, wherein both ends of the presser member are positioned outside both ends of the slide member, and both ends of the slide member are positioned outside both ends of the pressure rotation unit with respect to an axial direction of the heating rotation unit.

In the fixing device according to the one aspect of the present invention, both ends of the presser member are positioned outside both ends of the slide member, and both ends of the slide member are positioned outside both ends of the pressure rotation unit, so that both ends of the presser member are positioned most outside. Therefore, stress concentration caused by both ends (edges) of the presser member occurs in neither the slide member nor the pressure rotation unit. Thus, it is possible to suppress wear of the slide member and the pressure rotation unit.

Also, both ends of the slide member are positioned outside both ends of the pressure rotation unit. So, in the case where the pressure rotation unit is movable in the axial direction and where the slide member is not movable in the axial direction due to fixation of the slide member to the presser member, the presser member does not directly contact with the pressure rotation unit even when the pressure rotation unit is moved in the axial direction during rotation. This is because the slide member is intervened between the presser member and the pressure rotation unit. As the result, occurrence of damage or wear caused by the presser member is prevented in the inner surface of the pressure rotation unit.

Thus, the slide member and the pressure rotation unit can be improved in service life, so that the fixing device can be improved in service life.

In an embodiment of the fixing device according to the present invention, the presser member comprises a first pad having elasticity.

In an embodiment of the fixing device according to the present invention, the presser member comprises a first pad having elasticity and a second pad having hardness higher than the first pad, and the first pad is positioned on an upstream side of the second pad in a rotational direction of the pressure rotation unit on a contact surface between the heating rotation unit and the pressure rotation unit. (This can be more easily understood by regarding the rotation direction of the pressure rotation unit on the contact surface between the heating rotation unit and the pressure rotation unit as a stream.)

In an embodiment of the fixing device according to the present invention, the heating rotation unit has at least a rubber layer, and both ends of the presser member are positioned outside both ends of the rubber layer of the heating rotation unit with respect to the axial direction of the heating rotation unit.

Thereby, stress concentration which has been caused by the presser member does not occur in the heating rotation unit.

Therefore, it is possible to suppress distortions of the rubber layer of the heating rotation unit and wear of the outer circumferential surface (surface layer) of the heating rotation unit. Thus, the heating rotation unit can be improved in service life, so that the fixing device can be further improved in service life.

Another aspect of the present invention provides an image forming apparatus including the above-stated fixing device.

The image forming apparatuses according to this aspect of the present invention makes it possible to improve the image forming apparatuses in service life because the image forming apparatus includes the fixing device as described above.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the present invention will be described in detail by way of embodiments thereof illustrated in the accompanying drawings.

First Embodiment

Figure 1:
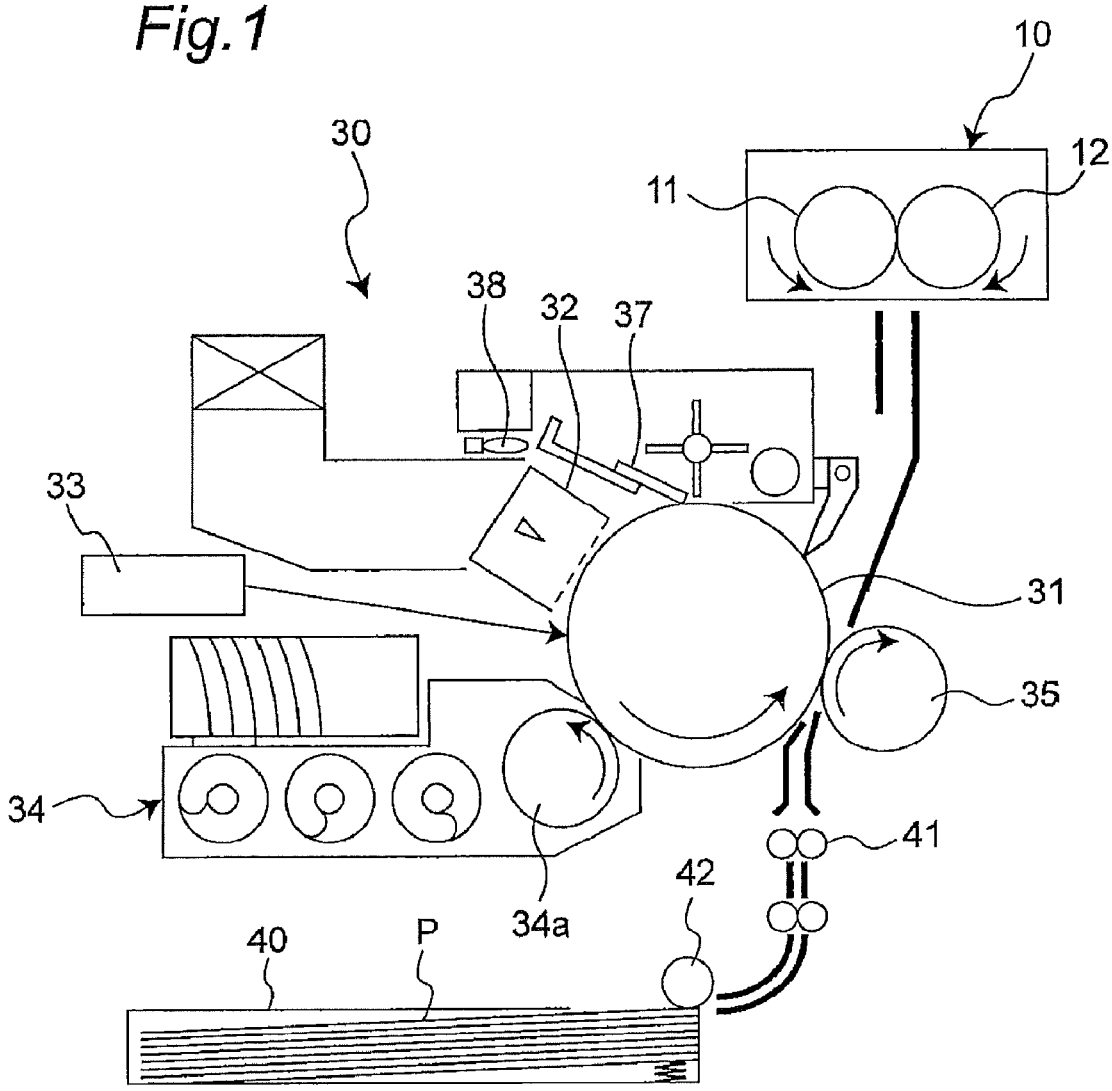
FIG. 1 shows a simplified configuration view of an image forming apparatus according to an embodiment of the present invention.

FIG. 1 is a simplified configuration view of an image forming apparatus according to a first embodiment of the present invention. The image forming apparatus has a fixing device 10 and an image forming device 30. The image forming device 30 makes unfixed toner deposited on a recording material P to form an image. The fixing device 10 fuses toner to fix the toner on the recording material P.

The image forming device 30 includes a photoconductor 31 for forming a toner image, and a transfer roller 35 for transferring the toner image formed by the photoconductor 31 onto the recording material P.

A surface of the photoconductor 31 is electrically charged uniformly to a specified potential by a charger 32, and then subjected to image exposure responsive to an original image by an exposure section 33 so as to form an electrostatic latent image on the photoconductor 31. The electrostatic latent image is developed by a developing section 34 having toner. That is to say, the developing section 34 has a developing roller 34*a* which a developing bias is applied to, so as to develop a visible toner image on the photoconductor 31.

The transfer roller 35 is pressed in contact against the photoconductor 31. The transfer roller 35, which a transfer voltage is applied to, transfers a toner image formed on the photoconductor 31 onto the recording material P.

The fixing device 10 has a heating roller 11 as a heating rotation unit, and a pressure belt 12 as a pressure rotation unit. The heating roller 11 and the pressure belt 12 rotate together in mutual contact of their outer circumferential surfaces. The heating roller 11 and the pressure belt 12 make the toner on the recording material P fixed, while carrying the recording material P in their mutual contact.

Next, operations of the image forming apparatus are explained.

By a sheet feed roller 42, the recording material P is drawn out one by one from a cassette 40, in which the recording material P is housed, and then the recording material P is fed to timing rollers 41.

In synchronization with a timing at which a toner image is formed on the photoconductor 31, the timing rollers 41 feeds the recording material P into between the photoconductor 31 and the transfer roller 35.

Passing through the recording material P between the photoconductor 31 and the transfer roller 35 allows the toner image to be transferred onto the recording material P. Thereafter, the toner image is fixed on the recording material P by the fixing device 10.

After transferring the toner image on the photoconductor 31, toner remaining on the photoconductor 31 is removed and cleaned by a cleaner 37, while static charge remaining on the photoconductor 31 is erased by an eraser 38.

Figure 2:
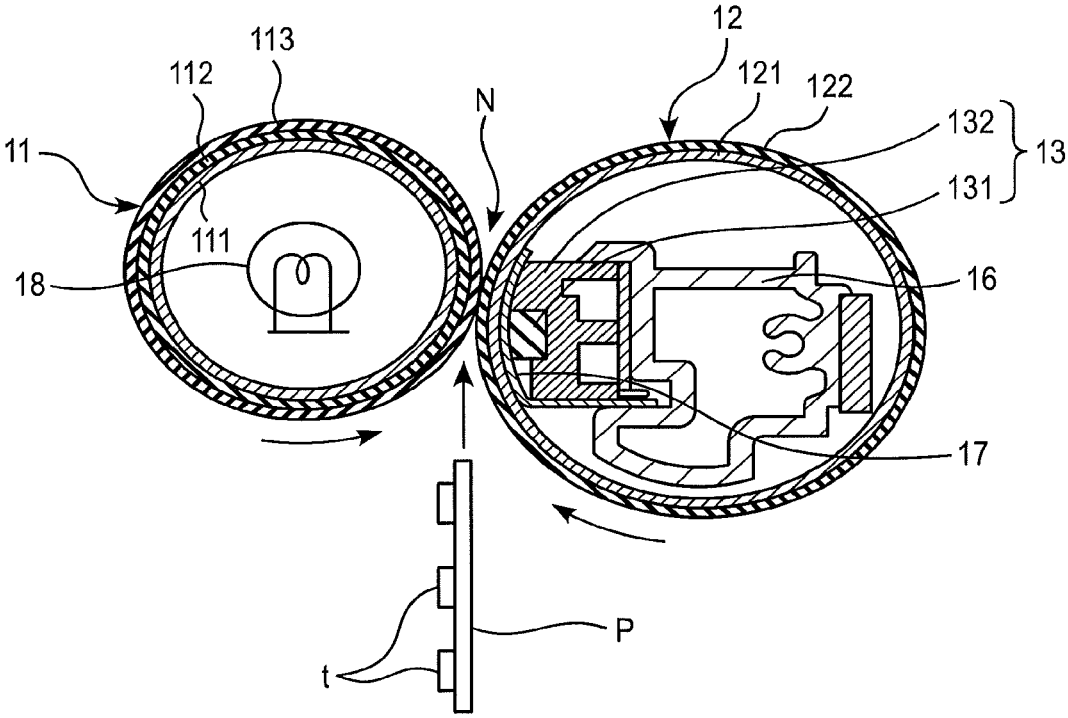
FIG. 2 shows a sectional view of a fixing device according to an embodiment of the invention.

FIG. 2 shows a simplified configuration view of the fixing device. This fixing device has a heating roller 11 (as a heating rotation unit), a pressure belt 12 (as a pressure rotation unit), a heater 18 (as a heating section), and a presser member 13. The heating roller 11 and the pressure belt 12 rotate together in mutual contact of their outer circumferential surfaces. The heater 18 is for heating the heating roller 11. The presser member 13 is placed inside the pressure belt 12 so as to press the pressure belt 12 toward the heating roller 11. A slide member 17 is placed between the pressure belt 12 and the presser member 13. The slide member 17 is put into sliding contact with the inner surface of the rotating pressure belt 12.

The heating roller 11 is rotated by a driving section such as an electric motor (unshown). The pressure belt 12 is rotated following after rotation of the heating roller 11 by friction with the heating roller 11.

The heating roller 11 and the pressure belt 12, while carrying the recording material P, contact with each other to make toner t on the recording material P fixed. Specifically, the toner t on the recording material P is fused and fixed at a nip portion N which is formed by mutual contact of the heating roller 11 and the pressure belt 12, while the recording material P is carried by the nip portion N.

The recording material P is a sheet such as paper sheet or OHP sheet, for example. Toner t is deposited on one surface of the recording material P, and the toner t is made from, for example, a material having heat-fusibility such as resin, magnetic material or coloring matter.

The heating roller 11 makes contact with one surface (image surface) of the recording material P. The heating roller 11 is a hollow roller. The heating roller 11 has an innermost metal cylinder 111, a rubber layer 112 and a surface layer 113 in this order from inner to outer side. An outer diameter of the heating roller 11 is desirably 10 to 50 mm as an example.

The innermost metal cylinder 111 is desirably made of a metal such as aluminum or iron, for example, and is pipe-shaped to have thickness of about 0.1 to 5 mm. The thickness is more desirably about 0.2 to 1.5 mm in consideration of weight reduction and warm-up time.

The rubber layer 112 is made of, for example, silicone rubber, fluororubber or the like whose material desirably has elasticity and high thermal resistance. Thickness of the rubber layer 112 is preferably about 0.05 to 2 mm. A hardness value of the rubber layer 112 is 10 to 40° JIS-A (Japanese Industrial Standard K6301-1975) and preferably 25±3° JIS-A.

The surface layer 113 is, for example, a fluorine-based tube or fluoro-based coating of PFA, PTFE, ETFE or the like, or a silicone tube or silicone coating, whose material has releasability and also may have the electrically conductive property. Its thickness is desirably about 5 to 100 μm (micron meters).

The fluorine-based tube may be, for example, PFA350-J, 451HP-J, 951HP Plus made by DU PONT-MITSUI FLUOROCHEMICALS COMPANY, LTD. A contact angle with water is not less than 90 degrees, and desirably not less than 110 degrees. The tube desirably has a surface roughness "Ra" of about 0.01 to 50 μm.

The pressure belt 12 has a base member 121 and a surface layer 122 in this order from inside to outside. The pressure belt 12 desirably has an outer diameter of 20 to 100 mm for example.

The base member 121 is made of polyimide, polyphenylene sulfide, nickel, iron, stainless steel or the like, for example.

The surface layer 122 is formed out of a fluorine-based tube or fluorine-based coating of PFA, PTFE, ETFE or the like, or a silicone-based tube or silicone-based coating whose material has releasability and may have the electrically conductive property. Its thickness is desirably about 50 to 150 μm.

In addition, a rubber layer may also be provided between the base member 121 and the surface layer 122. The rubber layer is formed from, for example, silicone rubber, fluororubber or the like whose material desirably has elasticity and high thermal resistance. Its thickness is desirably about 0.05 to 2 mm, which thickness is selected to be thinner than that of the rubber layer 112 of the heating roller 11. When a rubber layer is used for the pressure belt 12, a hardness value of the rubber layer is, for example, 20 to 60° JIS-A and preferably 43±3° JIS-A.

As stated above, surface hardness of the heating roller 11 and the pressure belt 12 is determined depending on conditions of material, hardness and thickness of components of the heating roller 11 and the pressure belt 12, where the surface hardness of the pressure belt 12 is set higher than the surface hardness of the heating roller 11.

In particular, the surface hardness of the pressure belt 12 is higher than the surface hardness of the heating roller 11 because the rubber layer 112 is present in the heating roller 11. Even when a rubber layer is provided in the pressure belt, the surface hardness of the pressure belt 12 is set higher than the surface hardness of the heating roller 11 by using the rubber layer 112 of the heating roller 11 higher in thickness and lower in hardness.

The presser member 13 is formed of a first pad 131 having elasticity, and a second pad 132 having hardness higher than the first pad 131.

The first pad 131 is formed from, for example, silicone-based rubber, fluorine-based rubber or the like which desirably has elasticity and high thermal resistance. Its thickness is desirably about 0.1 to 10 mm. Its hardness is desirably 15 to 30° in Asker C hardness.

The second pad 132 is made of, for example, a resin such as polyphenylene sulfide, polyimide or liquid crystal polymer, or a metal such as aluminum and iron, or ceramic or the like.

The first pad 131 is positioned on an upstream side of the second pad 132 in a rotational direction of the pressure belt 12 on a contact surface between the heating roller 11 and the pressure belt 12.

The first pad 131 is fitted to the second pad 132. The second pad 132 is fitted to a holding frame 16. The holding frame 16 is made of a metal such as aluminum or iron, for example, and formed from a drawn material, an extruded material, a sheet metal or the like.

The first pad 131 presses the pressure belt 12 toward the heating roller 11 while the pressure belt 12 is elastically deformed. The second pad 132 presses the pressure belt 12 toward the heating roller 11 on a downstream side of the first pad 131 in relation to the rotational direction of the pressure belt 12 on the contact surface between the heating roller 11 and the pressure belt 12.

Pressing by the elastic-deformation of the first pad 131 causes the toner t to be successfully fixed to the recording material P. Pressing by the second pad 132 causes the heating roller 11 to be distorted so as to decrease a contact power between the recording material P and the heating roller 11. Thereby, the recording material P can be easily separated off.

In addition, the presser member 13 may be formed of the first pad 131 alone, excluding the second pad 132.

A lubricant is applied to the inner surface of the pressure belt 12 by a lubricant supply section (unshown) so as to ensure lubricity between the pressure belt 12 and the slide member 17. This lubricant supply section is an oil applying felt, for example. The lubricant is silicone oil, for example. A viscosity of the lubricant is within a range from 200 to 400 cs (centistokes, $10^{-6}$ $m^2/s$).

Figure 3:
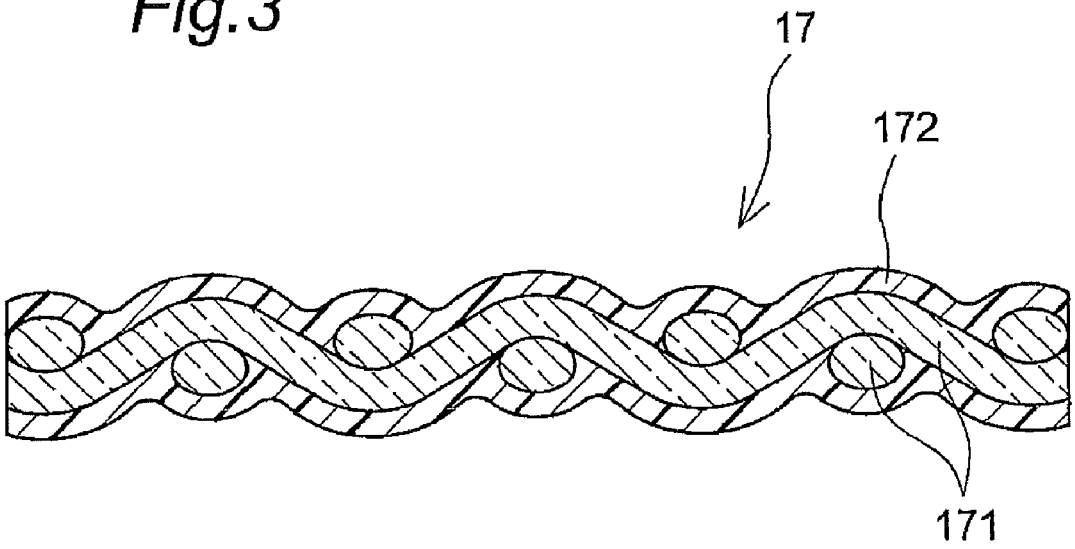
FIG. 3 shows a sectional view of a slide member.

As shown in FIG. 3, the slide member 17 has glass cloth 171 as a base member, and a heat-resistant resin 172 which the glass cloth 171 is coated with. In this case, if the slide member 17 has a smooth sliding surface, then the lubricant within a region of the nip portion N is easily pressed out, so that it becomes impossible to form a layer of the lubricant. Therefore, a scabrous sliding surface of the slide member 17 is formed by making use of irregularities of the glass cloth 171, where the glass cloth 171 is impregnated with PTFE of the heat-resistant resin 172 to be calcinated.

As shown in FIG. 3, the slide member 17 has glass cloth 171 as a base member, and a heat-resistant resin 172 which the glass cloth 171 is coated with. In this case, if the slide member 17 has a smooth sliding surface, then the lubricant within a region of the nip portion N is easily pressed out, so that it becomes impossible to form a layer of the lubricant because. Therefore, a scabrous sliding surface of the slide member 17 is formed by making use of irregularities of the glass cloth 171, where the glass cloth 171 is impregnated with PTFE of the heat-resistant resin 172 to be calcinated.

Figure 4:
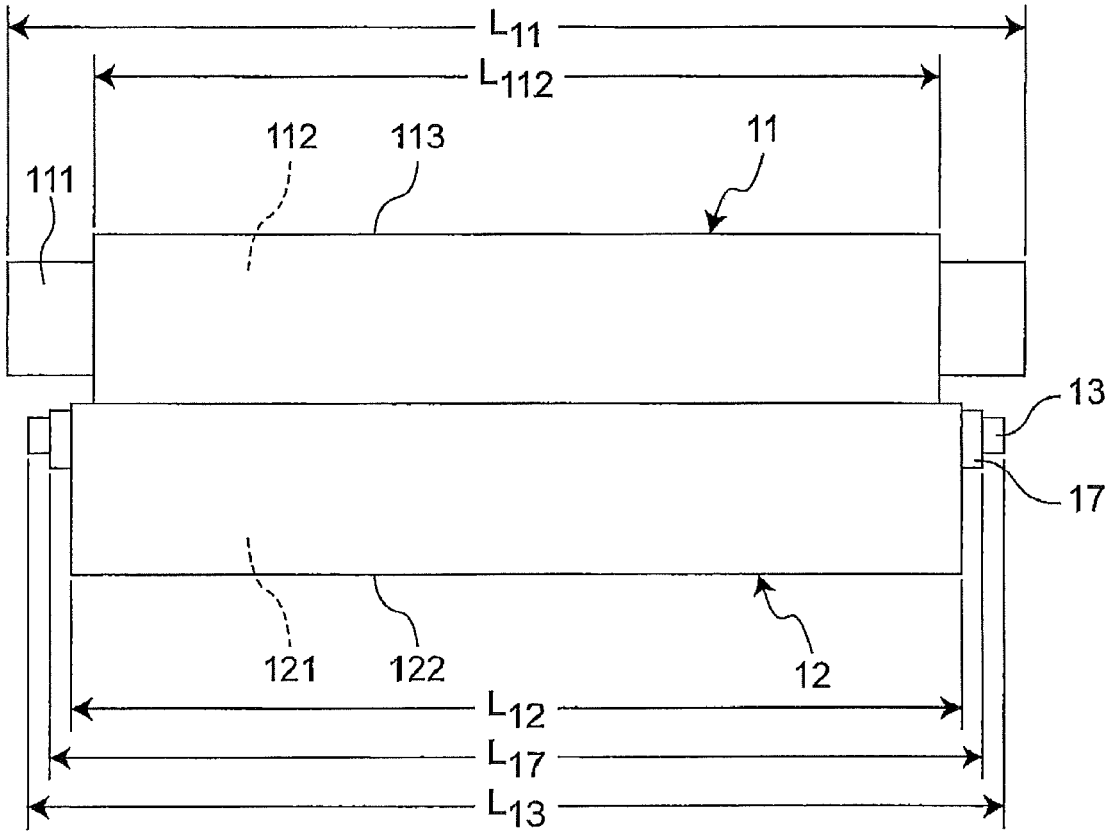
FIG. 4 shows a plan view of the fixing device.

FIG. 4 shows relationships among an overall length $L_{11}$ of the heating roller 11, an overall length $L_{112}$ of the rubber layer 112 of the heating roller 11, an overall length $L_{12}$ of the pressure belt 12, an overall length $L_{17}$ of the slide member 17, and an overall length $L_{13}$ of the presser member 13 with respect to the axial direction of the heating roller 11. In addition, an axial length may be called a width.

At both ends of the heating roller 11, neither the rubber layer 112 nor the surface layer 113 is present, so that the innermost metal cylinder 111 is exposed. In other words, the overall length of the rubber layer 112 is equal to the overall length of the surface layer 113, while the overall length of the innermost metal cylinder 111 is longer than the overall length of the rubber layer 112 and the overall length of the surface layer 113. Meanwhile, in the pressure belt 12, the overall length of the base member 121 and the overall length of the surface layer 122 are equal to each other.

The overall length $L_{13}$ of the presser member 13 is longer than the overall length $L_{112}$ of the rubber layer 112 of the heating roller 11. Both ends of the presser member 13 are positioned outside both ends of the rubber layer 112 of the heating roller 11.

The overall length $L_{13}$ of the presser member 13 is longer than the overall length $L_{12}$ of the pressure belt 12. Both ends of the presser member 13 are positioned outside both ends of the pressure belt 12.

The overall length $L_{13}$ of the presser member 13 is shorter than the overall length $L_{11}$ of the heating roller 11.

The overall length $L_{12}$ of the pressure belt 12 is longer than the overall length $L_{112}$ of the rubber layer 112 of the heating roller 11. Both ends of the pressure belt 12 are positioned outside both ends of the rubber layer 112 of the heating roller 11.

Both ends of the presser member 13 are positioned outside both ends of the slide member 17. Both ends of the slide member 17 are positioned outside both ends of the pressure belt 12. The overall length $L_{17}$ of the slide member 17 is longer than the overall length $L_{12}$ of the pressure belt 12 and shorter than the overall length $L_{13}$ of the presser member 13.

The service life of the fixing device depends principally on the heating roller 11 and the pressure belt 12.

More specifically, the service life of the heating roller 11 depends principally on wear of the surface layer 113, breakage of the rubber layer 112, flotation of the rubber layer 112 from the innermost metal cylinder 111, and flotation of the surface layer 113 from the rubber layer 112. The service life of the pressure belt 12 depends principally on wear of the surface layer 122.

Those phenomena occur at a position where the load (pressure) comes to a maximum. Therefore, in order to obtain an axially uniform pressure distribution, heretofore, the presser member has been formed into a centrally protruding shape so as to protrude toward a roller-contacting direction, and both ends of the presser member have been formed into a chamfered or rounded shape.

However, only these measures have not been enough. Both ends of the presser member have still contacted with the heating roller 11 and the pressure belt 12 in such a way as to cause occurrence of stress concentration at the ends.

According to the fixing device of this embodiment, the overall length $L_{13}$ of the presser member 13 is longer than the overall length $L_{112}$ of the rubber layer 112 of the heating roller 11, and both ends of the presser member 13 are positioned outside both ends of the rubber layer 112 of the heating roller 11. This absolutely prevents the stress concentration from occurring in the heating roller 11, which stress concentration has heretofore been caused by both ends (edges) of the presser member 13. Thus, it is possible to suppress distortions of the rubber layer 112 of the heating roller 11 and wear of the outer circumferential surface (surface layer 113) of the heating roller 11.

Besides, the overall length $L_{13}$ of the presser member 13 is longer than the overall length $L_{12}$ of the pressure belt 12. Moreover, both ends of the presser member 13 are positioned outside both ends of the pressure belt 12. Therefore, stress concentration due to both ends (edges) of the presser member 13 never occurs in the pressure belt 12. Thus, it is possible to suppress wear of the outer circumferential surface (surface layer 122) of the pressure belt 12.

For the above reasons, the service life of the heating roller 11 and the pressure belt 12 can be improved, so that the service life of the fixing device can be improved.

Furthermore, the overall length $L_{13}$ of the presser member 13 is shorter than the overall length $L_{11}$ of the heating roller 11. Therefore, mechanical drive components such as bearings and gears can be provided at ends of the heating roller 11 without being disturbed by the presser member 13. This makes it unnecessary to increase the overall length $L_{11}$ of the heating roller 11, so that upsizing of the fixing device can be suppressed.

Further, the overall length $L_{12}$ of the pressure belt 12 is longer than the overall length $L_{112}$ of the rubber layer 112 of the heating roller 11. Moreover, both ends of the pressure belt 12 are positioned outside both ends of the rubber layer 112 of the heating roller 11. Therefore, stress concentration due to both ends (edges) of the pressure belt 12 never occurs in the heating roller 11.

Therefore, it is possible to suppress distortions of the rubber layer 112 of the heating roller 11, wear of the outer circumferential surface (surface layer 113) of the heating roller 11. Thus, the service life of the heating roller 11 can be improved. In addition, even if stress concentration due to both ends (edges) of the heating roller 11 occurs in the pressure belt 12, wear of the surface of the pressure belt 12 can be prevented because the surface hardness of the pressure belt 12 is greater than that of the heating roller 11.

Further, both ends of the presser member 13 are positioned outside both ends of the slide member 17. Moreover, both ends of the slide member 17 are positioned outside both ends of the pressure belt 12. Therefore, it follows that both ends of the presser member 13 are positioned on the outermost side, so that stress concentration due to both ends (edges) of the presser member 13 occurs neither in the slide member 17 nor in the pressure belt 12. Therefore, it is possible to suppress wear of the slide member 17 and the pressure belt 12. Thus, it is possible to improve the service life of the slide member 17 and the pressure belt 12.

Both ends of the slide member 17 are positioned outside both ends of the pressure belt 12. In the case where the pressure belt 12 is movable in the axial direction and where the slide member 17 is fitted to the presser member 13 in such a way that the slide member 17 is immovable in the axial direction, the presser member 13 does not directly contact the pressure belt 12 even if the pressure belt 12 axially moves during its rotation. This is because the slide member 17 intervenes between the pressure belt 12 and the presser member 13. Thus, it is prevented to cause damage and wear of the inner surface of the pressure belt 12 due to the presser member 13.

According to an image forming apparatus of this embodiment, since the image forming apparatus includes the above-described fixing device, the apparatus service life can be improved.

Second Embodiment

Figure 5:
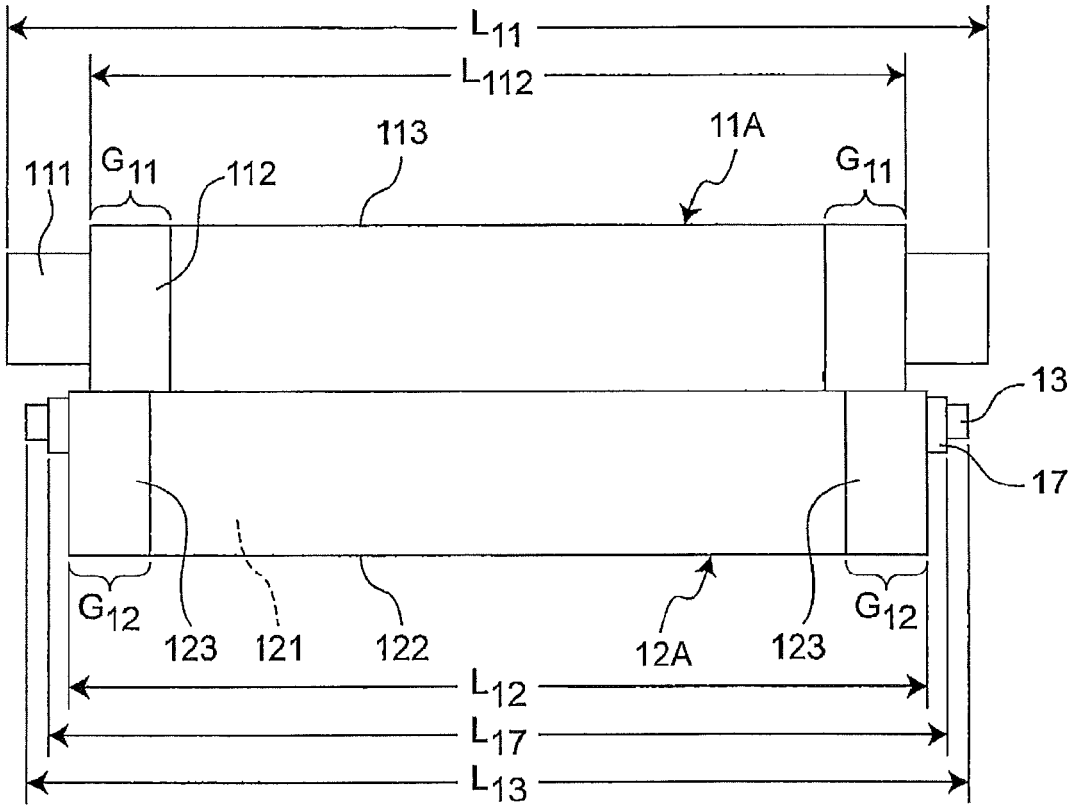
FIG. 5 shows a plan view of a fixing device according to another embodiment.

FIG. 5 shows a fixing device according to a second embodiment of the invention. The second embodiment differs from the first embodiment in structures of the heating roller and the pressure belt. In this second embodiment, components identical to those as those in the first embodiment have the same reference numerals, and description of the components is omitted.

In a heating roller 11A, as shown in FIG. 5, an overall length of the innermost metal cylinder 111 is longer than an overall length of the rubber layer 112, and the overall length of the rubber layer 112 is longer than an overall length of the surface layer 113. Both ends of the innermost metal cylinder 111 are positioned outside both ends of the rubber layer 112, and both ends of the rubber layer 112 are positioned outside both ends of the surface layer 113. Then, portions of the rubber layer 112, which portions are exposed on the surface of the heating roller 11A, form grip portions $G_{11}$.

Meanwhile, in a pressure belt 12A, a rubber layer 123 is provided outside both ends of the surface layer 122. Portions of the rubber layer 123, which portions are exposed on the surface of the pressure belt 12A, form grip portions $G_{12}$.

The grip portions $G_{11}$ of the heating roller 11A contacts with the grip portions $G_{12}$ of the pressure belt 12A.

The second embodiment is similar to the first embodiment (FIG. 4) in terms of the relations among the overall length $L_{11}$ of the heating roller 11A, the overall length. $L_{112}$ of the rubber layer 112 of the heating roller 11A, the overall length $L_{12}$ of the pressure belt 12A, the overall length $L_{17}$ of the slide member 17, and the overall length $L_{13}$ of the presser member 13.

Figure 6A:
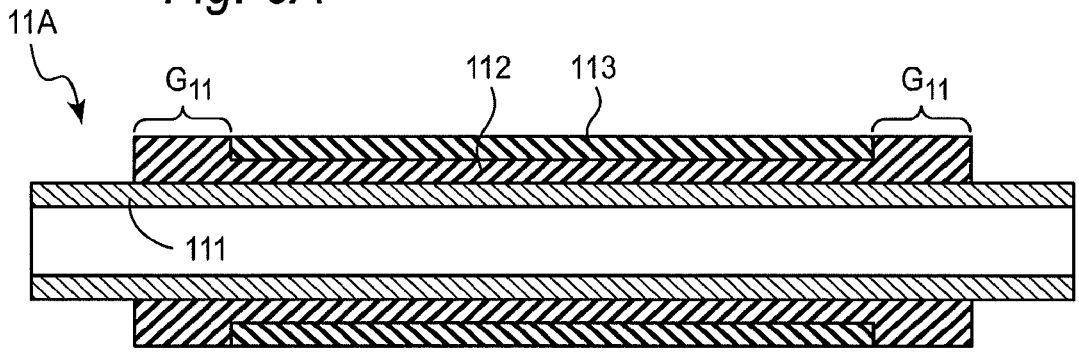
FIG. 6A shows a sectional view of a heating roller.

As shown in FIG. 6A, the heating roller 11A has the innermost metal cylinder 111, the rubber layer 112 and the surface layer 113 in this order from the inner side. The rubber layer 112 has a recess portion which positionally corresponds to an axially central portion of the heating roller 11A. The surface layer 113 is fitted into the recess portion.

In other words, each end of the heating roller 11A is made up of the innermost metal cylinder 111 and the rubber layer 112 in this order from the inner side. The central portion of the heating roller 11A is made up of the innermost metal cylinder 111, the rubber layer 112 and the surface layer 113 in this order from the inner side.

Figure 6B:
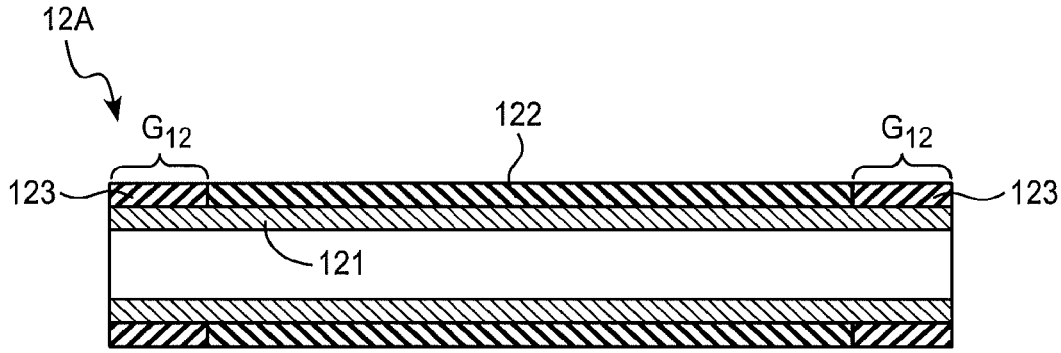
FIG. 6B shows a sectional view of a pressure belt.

As shown in FIG. 6B, the pressure belt 12A has the base member 121, the surface layer 122 and the rubber layer 123. The surface layer 122 and the rubber layer 123 are located radially outside of the base member 121. The rubber layers 123 are located so as to positionally correspond to ends of the pressure belt 12A. The surface layer 122 is located so as to positionally correspond to an axially central portion of the pressure belt 12A.

In other words, each end of the pressure belt 12A is made up of the base member 121 and the rubber layer 123 in this order from the inner side. The central portion of the pressure belt 12A is made up of the base member 121 and the surface layer 122 in this order from the inner side.

Thus, the grip portions $G_{11}$ of the heating roller 11A and the grip portions $G_{12}$ of the pressure belt 12A contact with each other, which makes it possible to increase a friction coefficient therebetween.

Thus, the grip portions $G_{11}$ of the heating roller 11A and the grip portions $G_{12}$ of the pressure belt 12A are securely in pressure contact with each other, so that it is possible to improve the frictional resistance between the grip portions $G_{11}$ of the heating roller 11A and the grip portions $G_{12}$ of the pressure belt 12A. As the result, the pressure belt 12A can securely be rotated following after rotation of the heating roller 11A.

The present invention is not limited to the above-described embodiments. For example, the layers forming the heating roller 11 may be freely increased or decreased so long as the heating roller 11 has at least the rubber layer 112. Also, the position of the rubber layer 112 may be changed in the heating roller 11. Also, the layers forming the pressure belt 12 may be freely increased or decreased. As the heating rotation unit, an endless belt may be used instead of the heating roller 11. Further, the heater 18 may be positioned outside the heating roller 11.

Also, the image forming apparatus may be any one of monochrome/color copiers, printers, facsimiles, multi-function machines of these functions and the like.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A fixing device comprising:

a heating rotation unit and a pressure rotation unit which rotate together in mutual contact;

a heating section for heating the heating rotation unit;

a presser member placed inside the pressure rotation unit to press the pressure rotation unit toward the heating rotation unit; and a slide member placed between the pressure rotation unit and the presser member and slid in contact with an inner surface of the rotating pressure rotation unit, wherein both ends of the presser member are positioned outside both ends of the slide member, and both ends of the slide member are positioned outside both ends of the pressure rotation unit with respect to an axial direction of the heating rotation unit.

2. The fixing device as set forth in claim 1, wherein the presser member comprises a first pad having elasticity.

3. The fixing device as set forth in claim 1, wherein the presser member comprises a first pad having elasticity and a second pad having hardness higher than the first pad, and the first pad is positioned on an upstream side of the second pad in a rotational direction of the pressure rotation unit on a contact surface between the heating rotation unit and the pressure rotation unit.

4. The fixing device as set forth in claim 1, wherein the heating rotation unit has at least a rubber layer, and both ends of the presser member are positioned outside both ends of the rubber layer of the heating rotation unit with respect to the axial direction of the heating rotation unit.

5. The fixing device as set forth in claim 4, wherein the presser member comprises a first pad having elasticity.

6. The fixing device as set forth in claim 4, wherein the presser member comprises a first pad having elasticity and a second pad having hardness higher than the first pad, and the first pad is positioned on an upstream side of the second pad in a rotational direction of the pressure rotation unit on a contact surface between the heating rotation unit and the pressure rotation unit.

7. An image forming apparatus including a fixing device comprising:

a heating rotation unit and a pressure rotation unit which rotate together in mutual contact;

a heating section for heating the heating rotation unit;

a presser member placed inside the pressure rotation unit to press the pressure rotation unit toward the heating rotation unit; and a slide member placed between the pressure rotation unit and the presser member and slid in contact with an inner surface of the rotating pressure rotation unit, wherein both ends of the presser member are positioned outside both ends of the slide member, and both ends of the slide member are positioned outside both ends of the pressure rotation unit with respect to an axial direction of the heating rotation unit.

8. The image forming apparatus as set forth in claim 7, wherein the presser member comprises a first pad having elasticity.

9. The image forming apparatus as set forth in claim 7, wherein the presser member comprises a first pad having elasticity and a second pad having hardness higher than the first pad, and the first pad is positioned on an upstream side of the second pad in a rotational direction of the pressure rotation unit on a contact surface between the heating rotation unit and the pressure rotation unit.

10. The image forming apparatus as set forth in claim 7, wherein the heating rotation unit has at least a rubber layer, and both ends of the presser member are positioned outside both ends of the rubber layer of the heating rotation unit with respect to the axial direction of the heating rotation unit.

11. The image forming apparatus as set forth in claim 10, wherein the presser member comprises a first pad having elasticity.

12. The image forming apparatus as set forth in claim 10, wherein the presser member comprises a first pad having elasticity and a second pad having hardness higher than the first pad, and the first pad is positioned on an upstream side of the second pad in a rotational direction of the pressure rotation unit on a contact surface between the heating rotation unit and the pressure rotation unit.

* * * * *